US005439418A

United States Patent [19]

Stephens

[11] Patent Number: 5,439,418

[45] Date of Patent: Aug. 8, 1995

[54] MOLDED DISTRIBUTOR RECEIVER AND PIN STORAGE MAGAZINE

[75] Inventor: Michael W. Stephens, Richmond, Va.

[73] Assignee: AMF Bowling, Inc., Mechanicsville, Va.

[21] Appl. No.: 292,181

[22] Filed: Aug. 19, 1994

[51] Int. Cl.[6] ..... A63D 5/09

[52] U.S. Cl. ..... 473/64; 473/89; 473/95

[58] Field of Search ..... 473/64, 83, 84, 86, 473/87, 88, 89, 90, 92, 94, 95, 96

[56] References Cited

U.S. PATENT DOCUMENTS

| | | | |
|---|---|---|---|
| 814,897 | 3/1906 | Backus | 473/83 |
| 2,688,487 | 9/1954 | Montooth | 473/64 |
| 3,219,345 | 11/1965 | Rogers . | |
| 3,248,108 | 4/1966 | Congelli et al. | 473/96 |
| 3,248,109 | 4/1966 | Blewitt, Jr. et al. . | |
| 3,526,401 | 9/1970 | Zuercher . | |
| 3,809,398 | 5/1974 | Schmid et al. . | |

FOREIGN PATENT DOCUMENTS

| | | | |
|---|---|---|---|
| 2021247 | 11/1971 | Germany | 473/90 |

*Primary Examiner*—Vincent Millin
*Assistant Examiner*—William M. Pierce
*Attorney, Agent, or Firm*—Bacon & Thomas

[57] ABSTRACT

A bowling pin storage device includes a one piece three dimensional molded magazine or bin having a plurality of elongated pockets for storing bowling pins in an essentially horizontal plane above a pin spotter. Each of the elongated cavities define a bowling pin shaped opening in the bottom thereof and include a shoulder portion for supporting the head of a bowling pin. The device also includes a plurality of movable wing like support elements for supporting the base or lower portion of bowling pins. The support elements hold or retain the pins within the storage bin when in a first position and when in a second position release the pins to fall downwardly to a pin spotting device.

7 Claims, 6 Drawing Sheets

MOLDED DISTRIBUTOR RECEIVER AND PIN STORAGE MAGAZINE

FIELD OF THE INVENTION

The present invention relates to a bowling pin storage device for use with a bowling pin delivery system and more particularly to a bowling pin storage device which includes a one piece magazine or bin having a plurality of cavities or pockets for storing bowling pins in an essentially horizontal plane above a pin spotter and for delivering the pins to a plurality of pin cups or a pin spotter for spotting on a pin deck.

BACKGROUND FOR THE INVENTION

In a bowling pin spotting machine during successive bowling frames the pins which are knocked down and pins remaining standing after each frame are generally delivered directly to the spotting machine or to a storage device from which pins are supplied on demand. In such machines, it is desirable to provide pins to the pin spotting machines which operate rapidly so that a game of bowling can be played swiftly without undue delays. It is important therefore, that the pin distributing system keep pace with the spotting machine and provide pins rapidly thereto and in a position for spotting on the pin deck. It is also important that any such mechanism minimize the likelihood of jams, misplaced pins or other failure which would take an alley out of service and/or cause and unacceptable delay in a game of bowling.

One approach to pin distribution is disclosed in the U.S. patent of Blewett, Jr. et al., U.S. Pat. No. 3,248,109. In that patent, a mechanical pin distribution structure is combined with an electrical operating system for programming the sequence of pin distribution. The distributer comprises a conveyor incorporating a cantilevered arm of fixed length which swings transversely above the receiver to which pins are delivered. The principal mechanical parts other than the swinging distributor are simple elements which can be used to deflect pins to assigned locations in the receiver. The distributor is indexed through a simple arc to various positions in transverse relation to the receiver and a prime mover for effecting the travel is controlled by a common central system.

The receiver in the prior art devices comprise a structure which defines a plurality of pin receiving pockets, compartments or bins arranged in conformity to the regulation array of pins spotted on an alley. The respective pin pockets 1–10 are essentially identical except that the number 1 pocket includes a plurality of rollers. The storage section having the pockets is supported from the machine frame below the level of the distributor and above a spotting table. Each of the pockets 1–10 is bottomless and the opening at the bottom of the pocket is obstructed by one of a plurality of bin cups. Each of the bin cups has an internal shape which is compatible with that of a bowling pin and is adapted to cradle a bowling pin when the cup is in a first position. Each of the cups is rotatable about its lengthwise axis by virtue of a trunnion mounting comprising a pair of spindles so that the cup can be rotated and the pin dropped from the cup.

A more recent approach to a pin distributing apparatus is disclosed in the U.S. patent of Zuercher, U.S. Pat. No. 3,526,401. As disclosed therein, a pin storage magazine is mounted beneath a conveyor and a plurality of pin storage pockets are arranged in a generally triangular format. The conveyor is moved across the magazine to deliver bowling pins into the pocket. A frame is provided with a plurality of pin supports which conform in arrangement with the arrangement of the pockets. The frame is mounted for movement beneath the magazine in a substantially horizontal plane beneath the magazine to effect discharge of a single pin from each of the pockets.

It is presently believed that there is a significant demand for an improved bowling pin storage device of a simplified design which incorporates a one piece molded storage bin and a minimum number of parts for storing a plurality of bowling pins in a horizontal plane and for delivering the pins to a plurality of pin cups for spotting on the pin deck of an alley.

A bowling pin storage device in accordance with the present invention incorporates a one piece molded storage bin and a minimal number of parts for retaining and/or releasing the pins from the bin. The device incorporates a simplified design which contributes to its exceptional durability, minimizes and facilitates maintenance, reduces alley down time and also minimizes the vertical height requirements for the pin delivery mechanism. In addition, the bin and device are relatively easy to manufacture and assemble at a relatively low cost.

BRIEF DESCRIPTION OF THE INVENTION

In essence, the present invention contemplates a bowling pin storage device for use with a pin delivery system. The device includes a molded three dimensional one piece structure or bin having a top and bottom, four sides and longitudinal and lateral axes between the top and bottom of the one piece structure. The one piece structure defines a plurality of oblong cavities or pockets which extend through the structure from the top to the bottom. The cavities each have a diminishing cross sectional area which decreases from the top of the structure in a direction toward the bottom of the structure. In a preferred embodiment of the invention, each of the cavities define a minimum cross sectional area, i.e., an opening having the general shape of a bowling pin taken along its longitudinal axis but having a cross sectional area slightly larger in width than the cross sectional area of a conventional bowling pin. Each of the cavities also includes a shoulder at its forward portion, i.e., the portion which corresponds to the head of a bowling pin. The opening is also shorter than the length of a conventional bowling pin and the cavity constructed and arranged to bias the base of a bowling pin in a forward direction so that the head of the pin rests on the shoulder in the forward part of the cavity. Releasable retaining means are provided for retaining a bowling pin in the cavity and for releasing the bowling pin so that it falls base first through the cavity and into a pin cup or other delivery system.

DETAILED DESCRIPTION OF THE PREFERRED EMBODIMENT OF THE INVENTION

The invention will now be described in connection with the accompanying drawings wherein like numbers have been used to define like elements.

Figure 1:
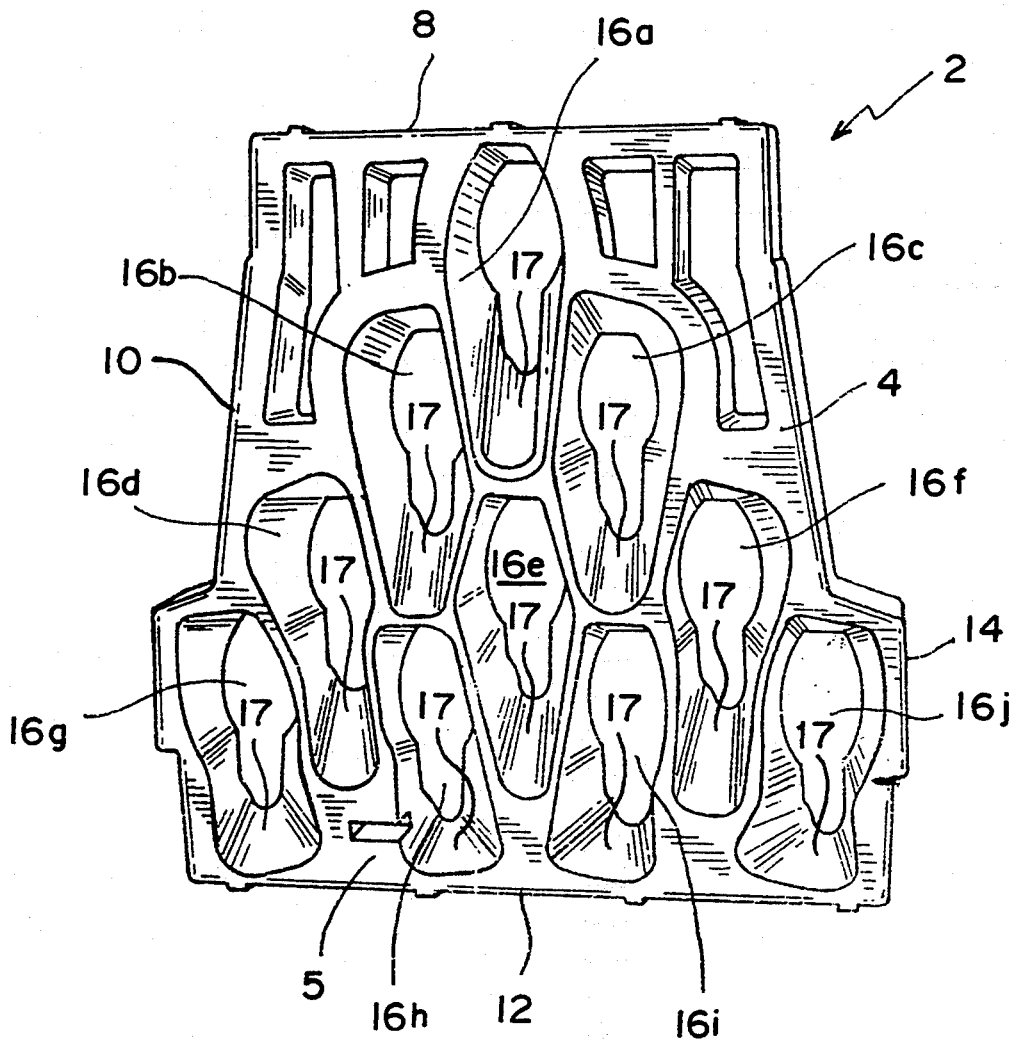
FIG. 1 is a perspective view of bowling pin storage bin in accordance with a preferred embodiment of the invention.

As shown in FIG. 1, a bowling pin storage device 2 for use with a pin spotting system (not shown) includes a molded three dimensional one piece structure or bin 4 having a top 5 and bottom 6. The structure 4 may, for example, be made of linear low density polyethylene and formed by rotational molding or other method of fabrication as will be well understood by a person of ordinary skill in the art. The one piece structure or bin 4 has four sides 8, 10, 12 and 14. And, in the preferred embodiment of the invention the bin 4 defines a generally trapezoidal shape with a height that is greater than the width at its base. Therefore, side 8 is referred to as the forward side while side 12 forms the base of the trapezoid or rear of the structure and sides 10 and 14 which form the sides of the trapezoid are longer than the width of the base, i.e., of side 12. The bin 4 also includes longitudinal and lateral axes between the top 5 and bottom 6 of the one piece structure.

The one piece structure or bin 4 also defines a plurality of longitudinally extending oblong pockets or cavities 16 *a–j* which extend through the structure 4 from the top 5 to the bottom 6. The cavities 16 *a–j* are arranged in conformity to the regulation array of pins spotted on the pin deck (not shown) and each cavity has a diminishing cross sectional area which decreases from the top 5 of the structure in a direction toward the bottom 6 of the structure.

Figure 4:
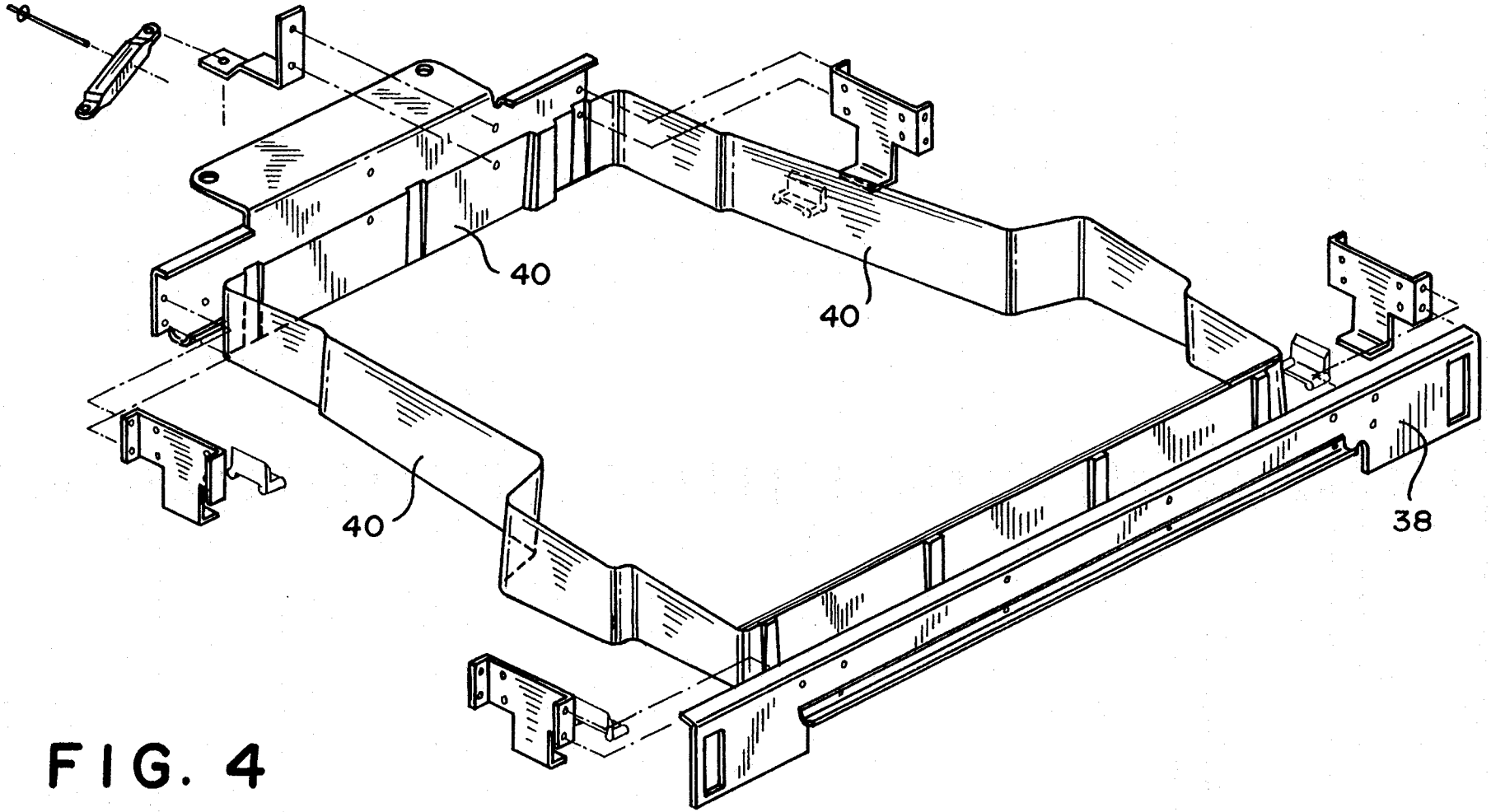
FIG. 4 is an exploded perspective view of a frame assembly for supporting the storage bin shown in FIGS. 1 and 2.

Each of the cavities 16 *a–j* define a minimum cross sectional area, i.e., an opening having the general shape of a bowling pin taken along its longitudinal axis but having a width slightly larger in width than the width of a conventional bowling pin. In the preferred embodiment of the invention, each of the cavities 16 *a–j* also includes a shoulder 17 at its forward portion, i.e., the portion which corresponds to the head of a bowling pin. The opening is also shorter than the length of a conventional bowling pin and the cavities 16 *a–j* are each constructed and arranged to bias the base 19 of a bowling pin 20 in a forward direction so that the head of the pin rests on the shoulder 17 in the forward part of cavity 16. As shown more clearly in FIG. 4, the end wall 16' slopes downward and outward to force a bowling pin in a forward direction so that the head of the pin will rest on shoulder 17.

Figure 2:
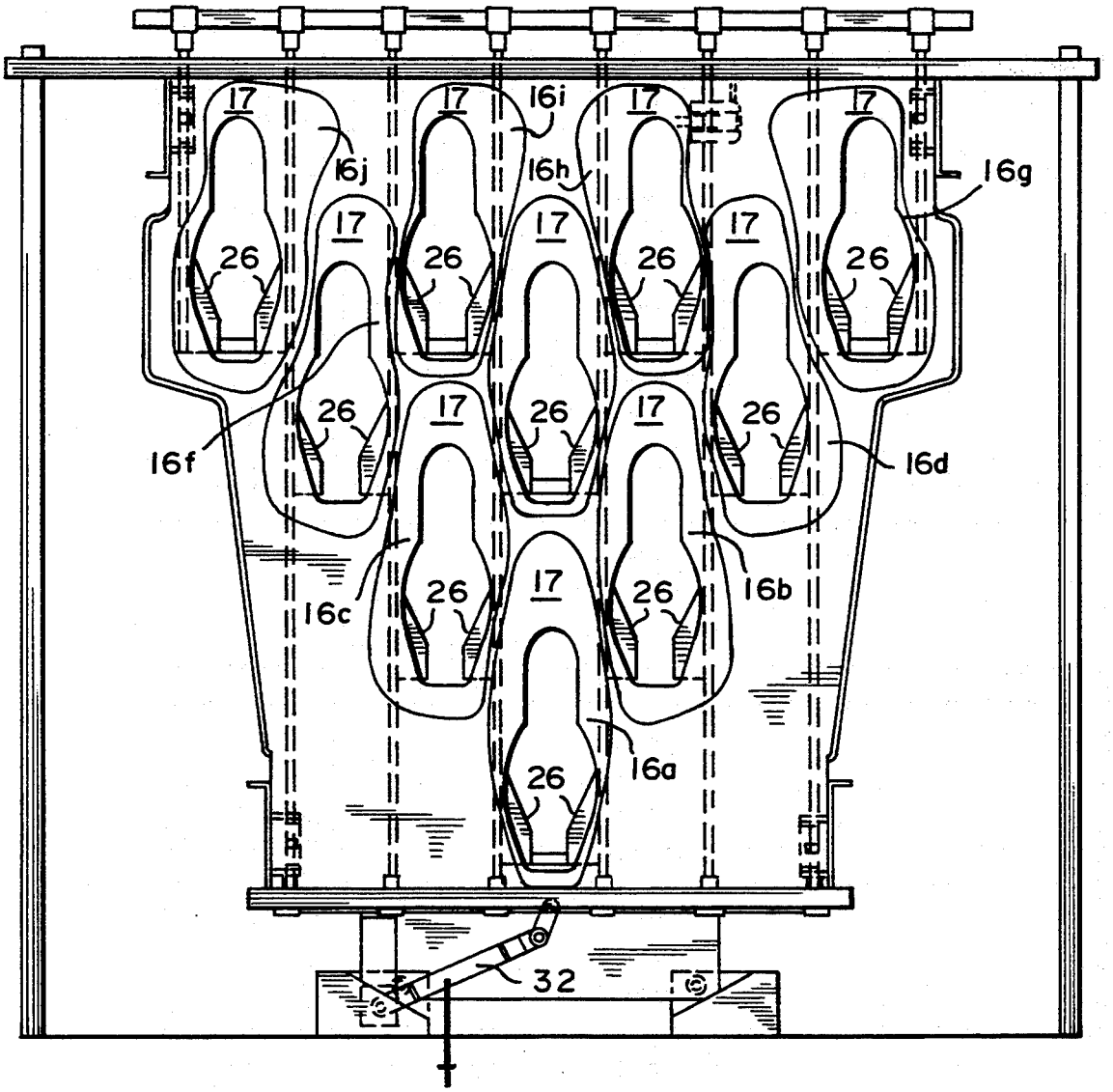
FIG. 2 is a top plan view of the storage bin shown in FIG. 1, but including a mechanism for retaining a plurality of bowling pins in the storage bin.
Figure 3:
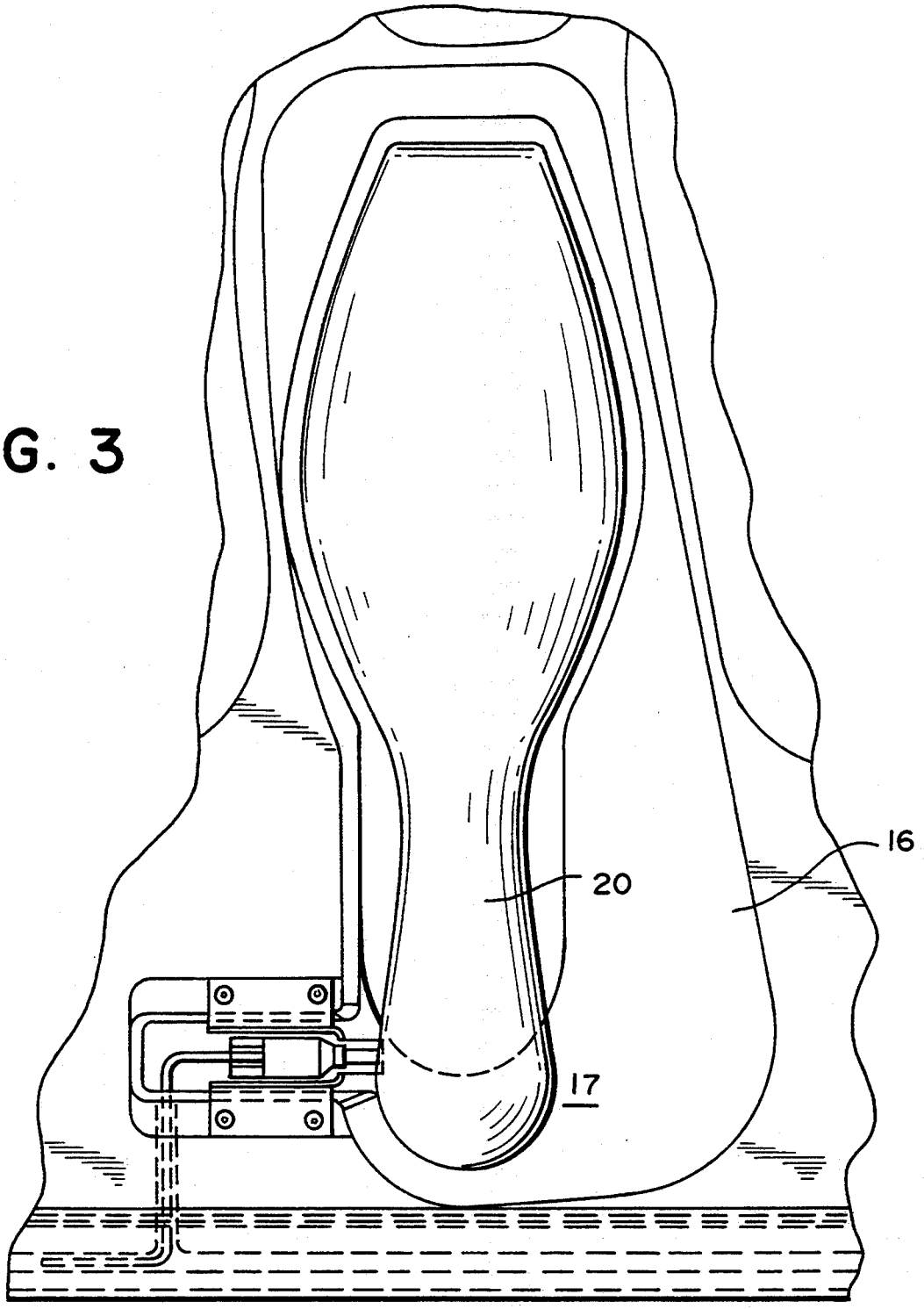
FIG. 3 is a top plan view of a cavity shown in FIG. 2, but showing a conventional bowling pin as it is stored therein without the retaining mechanism.
Figure 5:
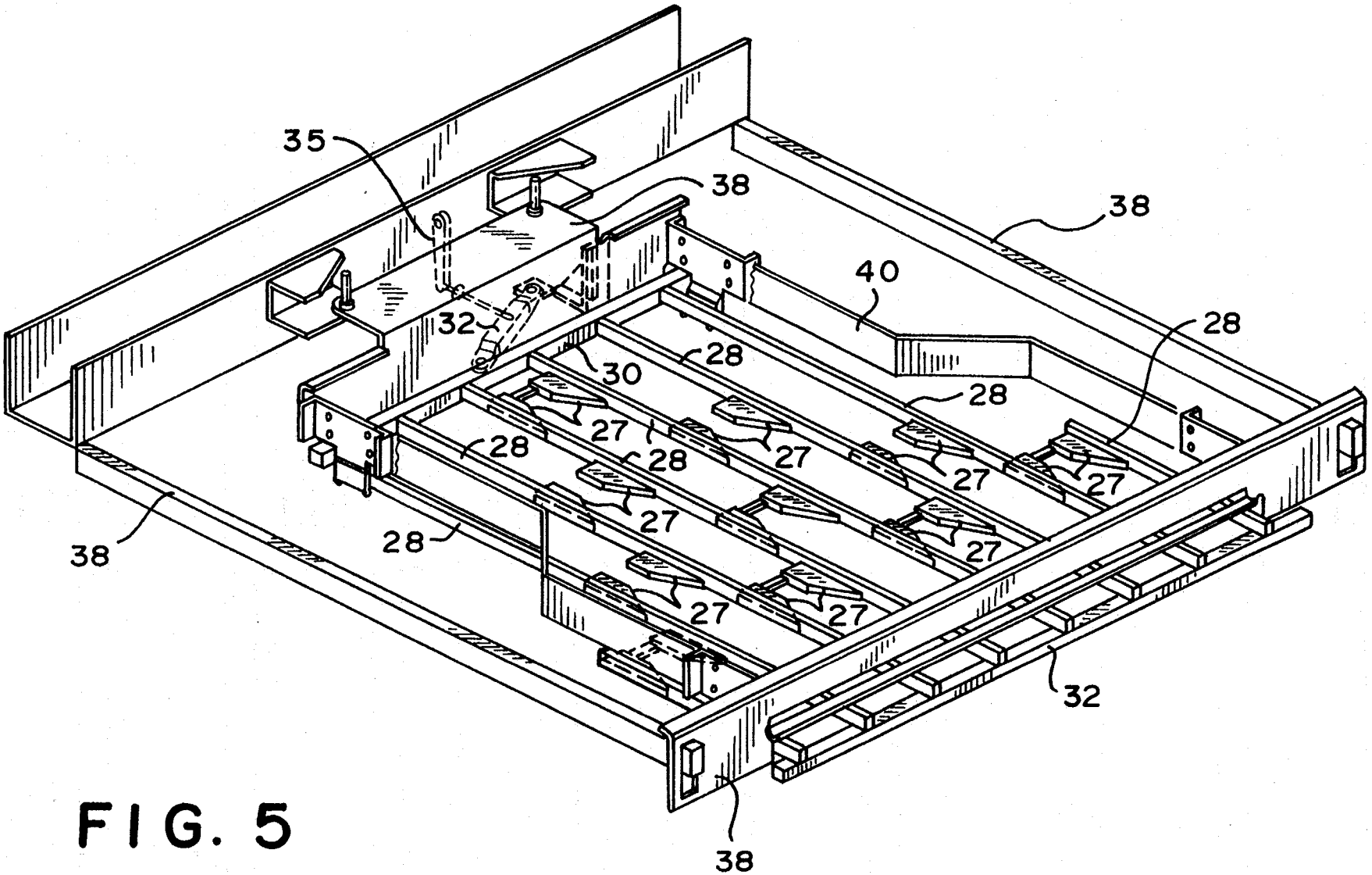
FIG. 5 is a perspective view of the retaining and release mechanism for use in a bowling pin storage device in accordance with a preferred embodiment of the invention; and, FIG. 6 is a side elevational view of the bowling pin storage device in accordance with the preferred embodiment of the invention.
Figure 6:
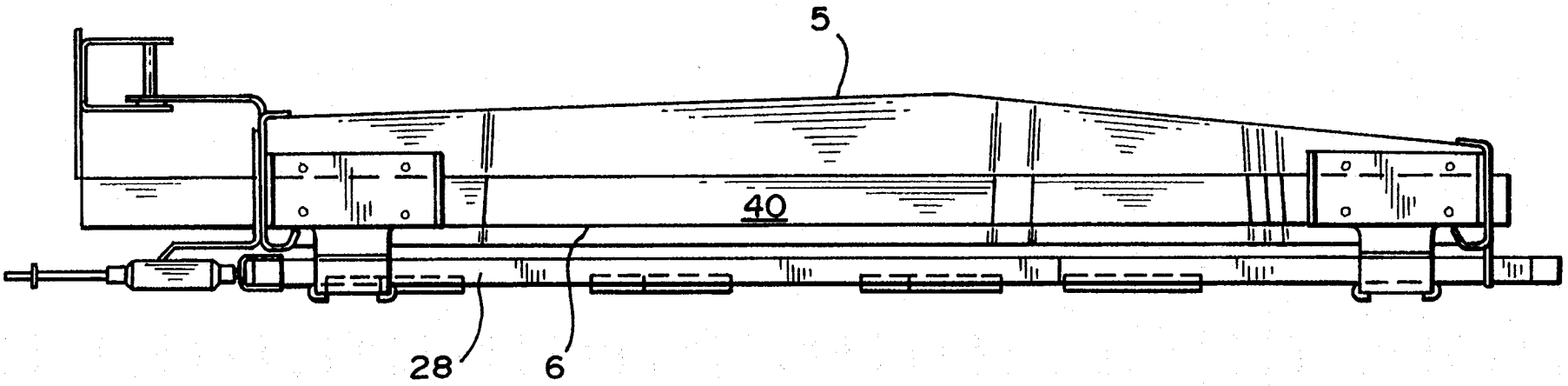

Releasable retaining means or a shuttle linkage assembly 24, shown more clearly in FIGS. 2 and 5, is disposed below the storage structure or bin 4 and acts in cooperation with the cavities 16 for retaining a set of bowling pins in the cavities 16 *a–j* and for releasing the bowling pins so that they tend to fall base first through the cavities 16 *a–j* and into the pin cups (not shown) or other delivery system. The pin cups and other mechanisms for setting pins on a pin deck are of conventional design and may, for example, take the form of the pin cups in the aforementioned Blewitt Jr. patent U.S. Pat. No. 3,248,109 which is incorporated herein in its entirety by reference.

The linkage assembly 24 may include a plurality of movable support members 26 which prevent the bowling pins 20 from falling through the cavities 16 when in their first or supporting position. In a preferred embodiment of the invention, see FIG. 5, the support members 26 comprise a pair of wing like elements 27, one pair associated with each of the cavities 16 *a–j*. The elements 27 are fixed to a plurality of rods 28 which are reciprocally movable in a generally horizontal plane by means of a first cross member 30. A second cross member 32 at the opposite ends of rods 28 provides structural rigidity, so that, the assembly 24 can be reciprocated by means of a drive mechanism 35. The drive mechanism 35 and control means, not shown, are of conventional design.

The linkage assembly 24 or shuttle linkage, as it is sometimes called, is disposed in a suitable frame 38 which is disposed immediately below bin 4 and constructed and arranged to maintain the pins 20 within the cavities 16 *a–j*. The bin 4 is likewise supported by a frame 40 which is shown more clearly in FIG. 4 and held therein by a plurality of unnumbered screws or bolts in a conventional manner.

As the shuttle linkage assembly 24 is moved in a first direction, the elements 27 are moved out from under a set of bowling pins 20 and since the forward or head of the pins 20 are supported by shoulders 17, allows the pins to drop into a pin cup. The linkage assembly is moved reciprocally so that the elements 27 are moved out from under a pin and back rather quickly since the bin 4 may hold more than one pin. For example, in the preferred embodiment of the invention two pins will customarily be stored in each of the cavities 16 *a–j* with one pin lying on top of the other and dropping down onto elements 27 and shoulder 17 as the first pin drops into the pin cup.

While the invention has been described in connection with a preferred embodiment, it should be recognized that changes and modifications may be made without departing from the scope of the appended claims.

What is claimed is:

1. A bowling pin storage bin for use with a pin delivery system comprising a molded three dimensional one piece structure having a top and a bottom and two pairs of oppositely disposed sides, a longitudinal axis running between a first pair of sides and a lateral axis running between a second of said pair of oppositely disposed sides, said one piece structure having a plurality of oblong cavities extending through said structure from said top to said bottom, said cavities having a diminishing cross sectional area from said top of said structure toward said bottom of said structure and with each of said cavities having a minimum cross sectional area which defines the general shape of a bowling pin taken along its longitudinal axis but having a cross sectional area slightly larger in width but shorter in length than the cross sectional area of a conventional bowling pin taken along its longitudinal axis so that a conventional bowling pin falling into one of said cavities with its longitudinal axis parallel to the longitudinal axis of said structure will pass through said structure and releasable retaining means in cooperation with each of said cavities for retaining a bowling pin cradled in said cavity with the bowling pin's longitudinal axis generally parallel to the longitudinal axis of said structure, and means for releasing the bowling pin so that it passes through said structure and into a pin delivery system.

2. A bowling pin storage bin for use with a pin delivery system according to claim 1 which includes means for cradling the bowling pin with its longitudinal axis lying in a generally horizontal plane and means for causing the bowling pin to rotate so that its longitudinal axis rotates toward a generally vertical position as the pin falls out of said oblong cavity and into the pin delivery system.

3. A bowling pin storage bin for use with a pin delivery system according to claim 1 in which said cavities include shoulder means for supporting a head portion of a bowling pin.

4. A bowling pin storage bin for use with a pin delivery system according to claim 3 in which said storage structure has a generally trapezoidal shape.

5. A bowling pin storage bin for use with a pin delivery system according to claim 3 in which a portion of said cavity extends forwardly of the portion of the opening that corresponds to the head of a bowling pin and said cavities include biasing means for biasing the head of the bowling pin toward that portion of the cavity.

6. A bowling pin storage bin for use with a pin delivery system according to claim 5 which includes ten cavities arranged in a generally triangular pattern.

7. A bowling pin storage bin for use with a pin delivery system according to claim 6 in which said cavities overlap one another.

* * * * *